US005479144A

United States Patent [19]

Gurol

[11] Patent Number: 5,479,144

[45] Date of Patent: Dec. 26, 1995

[54] MULTIPOLE CONNECTOR FOR ACCELERATOR MAGNET ENDS

[75] Inventor: Husam Gurol, Encinitas, Calif.

[73] Assignee: Martin Marietta Corporation, San Diego, Calif.

[21] Appl. No.: 130,329

[22] Filed: Oct. 1, 1993

[51] Int. Cl.[6] ..... H01F 7/22; H01H 5/00

[52] U.S. Cl. ..... 335/216; 335/301; 335/211; 335/214

[58] Field of Search ..... 335/210–214, 335/216, 296–301; 505/1, 705, 879; 324/318, 319, 320; 315/8, 5.35, 5.41; 328/162, 165, 166, 227, 228, 230, 233

[56] References Cited

U.S. PATENT DOCUMENTS

| | | | |
|---|---|---|---|
| 4,612,505 | 9/1986 | Zijlstra | 324/318 |
| 4,748,413 | 5/1988 | Frese et al. | 324/318 |
| 4,758,813 | 7/1988 | Holsinger et al. | 335/306 |

*Primary Examiner*—Leo P. Picard
*Assistant Examiner*—Ramon M. Barrera
*Attorney, Agent, or Firm*—John R. Duncan; Frank D. Gilliam

[57] ABSTRACT

A method and apparatus for correcting harmonics (multipoles) in high energy particle accelerators using superconducting magnets using corrector rods adjacent to accelerator magnets. In such accelerators, superconducting coils are positioned around a non-magnetic beam tube with the magnetic coils designed to guide particles, such as protons, along the tube. Magnetic field non-uniformites in the form of multipoles (harmonics) will disrupt the beam guidance, causing particles to hit the tube walls and be lost, reducing accelerator efficiency. The negative effects of multipoles (harmonics) in such accelerators can be reduced or eliminated by positioning a selected number of pairs of carefully sized and dimensioned rods of magnetic material such as nickel or iron along the exterior of the beam tube or enclosing helium vessel near the magnet ends. The rods are equally spaced and lie parallel to the beam tube axis. The rods negate the field non-uniformities generated by the unavoidable multipoles generated by the magnetic coils. Where a number of magnets from different vendors, using somewhat different materials, etc., must be used together, often different sets of magnets have different harmonic characteristics. The tunable corrector rods will allow these manufacturing variations to be corrected in each set. The multipole harmonic effects for each set is measured through empirical tests, and the dimensions of the corrector rods are selected for use with that set.

11 Claims, 1 Drawing Sheet

MULTIPOLE CONNECTOR FOR ACCELERATOR MAGNET ENDS

BACKGROUND OF THE INVENTION

This invention relates in general to superconducting accelerator magnets and, more specifically to a method and apparatus for passively correcting for variations in magnetic field uniformity between different, though identically, designed magnets.

Magnetic fields guide particles, such as protons, through beam tubes. Particles can be accelerated to speeds approaching the speed of light by accelerators made up of a number of axially arranged high field magnets, with beam tubes under high vacuum that contain the particles.

In high energy physics research, such magnets have been used to accelerate and guide particles and cause collisions between them to reveal the presence of more fundamental particles and forces. Particle accelerators are also used in medical research and treatment, where tissues are bombarded with selected particles to change or destroy selected types of tissue, such as tumors. Other applications include x-ray lithography and protein crystallography Superconductors are materials, typically metals or ceramics, that lose all resistance when cooled below a critical temperature. Many materials have superconducting capabilities, although most only superconduct at temperatures approaching 0 K. The most practical superconductors for use in superconducting magnets are those that superconduct at or above the boiling temperature of liquid helium. Nb-Ti and $Nb_3Sn$ are the most common superconducting materials. Recently, ceramic superconductors, such as $YBa_2Cu_3O_7$ have been developed that have critical temperatures above the boiling temperature of liquid nitrogen.

Magnets formed from Superconductors and cooled below their critical temperatures are highly efficient and can provide extremely high magnetic fields. Such magnets are used in particle accelerators used in medical treatment, physics research and other fields. The Superconducting Supercollider will use thousands of superconducting magnets to guide particles through a very long, multi-magnet tube. These magnets require very high field uniformity in order to guide the particle beam through the beam tube without an excessive number of particles striking the inner surface of the tube and lost. The high field uniformity requirement in turn imposes tight tolerances for the parts and assembly of the magnets. Significant sources of error, in addition to assembly and random error stack-up, include the use of superconductors and other parts from different vendors.

Magnetic non-uniformities or "multipoles" that exist in accelerator magnets have historically shown significant variation between different sets of magnets. Unless controlled, the large values of multipoles, as well as the magnet-to-magnet variability can result in shorter accelerator operating times, and hence increased accelerator costs.

Greater control of the multipoles will allow broader manufacturing tolerances which will substantially lower the cost of accelerator magnets while improving performance. For example, collars are used to secure the magnet coils around the beam tube. It has been found that variations in the tightness of these collars from set to set of manufactured magnets are particularly significant in varying the persistent current and harmonic effects from set to set. In the past, attempts were made to use active corrector magnets positioned at selected locations in the system. These magnets, however, were not particularly effective, were difficult to fit into the system and significantly increased system cost. Similarly, attempting to enforce very tight tolerances is very expensive, often causing the rejection large percentage of completed magnets as out-of-tolerance.

Thus, there is a continuing need for methods of correcting variations in magnet multipoles between different sets of magnets.

SUMMARY OF THE INVENTION

The above noted problems, and others, are overcome in accordance with this invention, basically, by securing a non-magnetic plate to the end of the vessel that contains the liquid refrigerant (such as liquid Helium) of an accelerator magnet, and mounting a selected number of magnetic metal rods (such as iron or nickel) to the plate so that the rods extend adjacent to the ends of the accelerator coils and parallel to the beam tube within the coil assembly.

After a set of particle accelerator magnets is manufactured, established testing methods are used to measure the harmonic characteristics (multipoles) of sample magnets from the set. The size and location of corrector rods are then selected to overcome any variations of these characteristics from the desired norm. With newly designed magnets, the selection of rod size, spacing, etc. of the corrector rods will be based on iteration between measurement and calculations. With some experience with how much variability the magnets are exhibiting the corrector rod configurations will become predictable. Computer simulations will aid in reducing the empirical establishment of standards for the corrector rods.

While any suitable magnetic material may be used in the corrector rods, we have found that the material should be one that is fully magnetized at the field levels that it sees during operation at the field level at which correction is desired. Typical operating fields will be injection at 0.7 Tesla to about 7 Tesla at full field. Typically, beam injection takes about 30 minutes, with the accelerator typically operating for about 24 hours continuously, maintaining the particle beam. It is apparent that any significant loss of particles to the beam tube walls will severely reduce the effectiveness of the system over such periods. We have found that nickel, Monel and iron are the most effective, and therefore preferred, materials for use in corrector rods. Other materials, including paramagnetic and high temperature superconducting ceramics may bemused, depending on the multipole to be corrected.

The corrector rods may have any suitable dimensions. The rod lengths should be sufficient to extend past the end region of the magnet coils, where the coil fields are reversing direction. For coils of the sort used in the Superconducting Supercollider dipole magnets, lengths of from about 10 to 50 centimeters, and diameters of from about 1 to 2 centimeters are generally suitable.

The end plate diameter should be sufficient so that the periphery extends past the edges of the helium vessel. From 2 to 18 equally spaced holes may be provided, depending upon the multipole harmonic to be corrected. Most often the $b_2$ sextupole harmonic is in need of correction. Two to four corrector rods on opposite sides of the plate, located in accordance with measurements of the sextupole harmonic, are generally effective. The end plate may be formed from any suitable non-magnetic material, such as non-magnetic stainless steel or fiber reinforced synthetic resins.

Corrector rods may be secured to the end plate in any suitable manner, such as mutual threads, welding or solder. The use of female threads in the plate holes and corresponding male threads on the rod ends, with lock nuts where necessary or desirable, is preferred to permit testing with different rod sizes and locations to determine the optimum parameters. Once the proper rod size and location are determined for a specific set of magnet assemblies, the free end of each corrector rod could be secured to the exterior of the helium vessel, along which the rods extend, by taping the rods to the vessel or any other suitable method.

While other arrangements may be used, we have found that with a dipole magnet, four corrector rods, equally spaced around the beam tube magnet assembly give the maximum correction, especially of the most significant sextupole harmonic. With magnets having a greater number of poles, or where other harmonics are most significant, a greater number of rods may be preferred, still substantially equally spaced around the tube. The optimum number and sizing of rods can be easily determined through empirical tests.

BRIEF DESCRIPTION OF THE DRAWING

Details of the invention, and of certain preferred embodiments thereof, will be further Understood upon reference to the drawing, wherein.

DETAILED DESCRIPTION OF PREFERRED EMBODIMENTS

Figure 1:
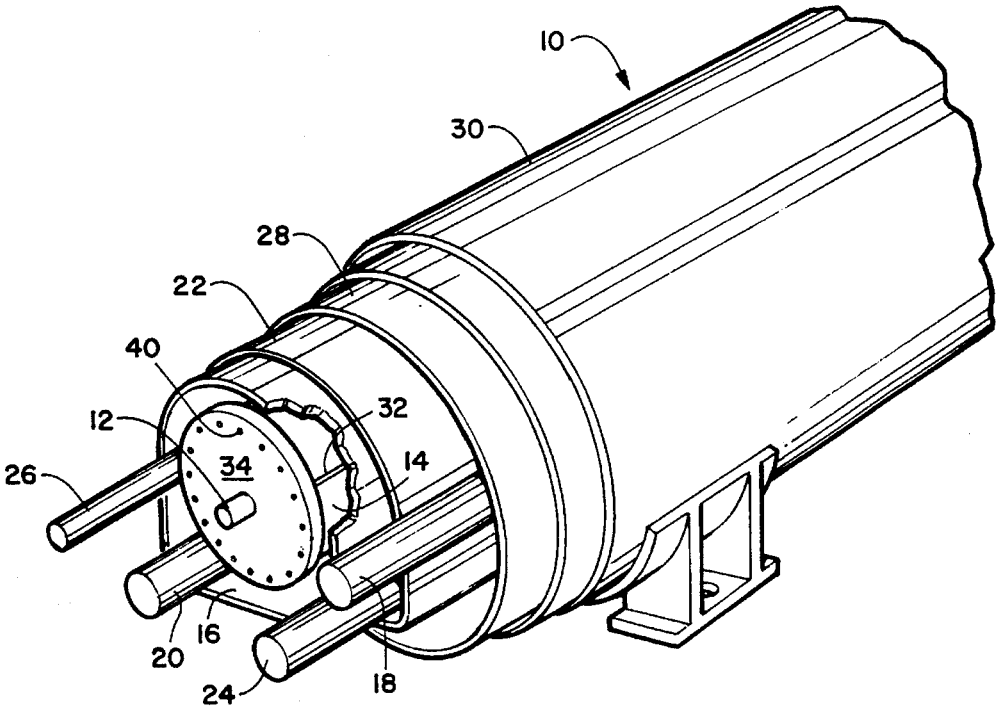
FIG. 1 is a perspective view of a typical particle accelerator magnet assembly, partially cut-away to show the corrector rod location.

Referring now to FIG. 1, there is seen a perspective view of a particle accelerator magnet assembly 10 with the near end partially cut away to show the internal components. This accelerator is typical of the main dipole magnets which guide particles in the Superconducting Supercollider.

At the center of assembly 10 is the evacuated beam tube 12 that carries the stream of particles at a velocity near the speed of light. Surrounding beam tube 12 is a helium vessel 14 that contains the superconducting magnetic coils (as seen in FIG. 3) that surround beam tube 12. The coils are conventionally formed from superconducting alloys that have critical temperatures above the boiling temperature of liquid helium, so that they are superconducting when maintained at liquid helium temperatures.

A 20 K shield or housing 16 surrounds helium vessel 14. Line 18 brings liquid helium to vessel 14 while line 20 removes gaseous helium. Surrounding the 20 K shield is an 80 K shield or housing 22 containing liquid nitrogen to reduce heat flow to the inner components. Liquid nitrogen is brought to shield 22 through line 24 and gaseous nitrogen is removed through line 26. Liquid nitrogen is much less expensive than liquid helium, so that benefits derive from absorbing heat in the liquid nitrogen rather than the liquid helium. In the future, as the recently developed high temperature superconductors that have critical temperatures just below the boiling temperature of liquid nitrogen become commercially available, the helium system may no longer be needed.

Multiple layers of high efficiency thermal insulation material 28 surround the shield assembly to further reduce heat flow into the system. An outer vacuum vessel 30 surrounds the entire assembly. Much of the system thermal insulation is accomplished by the vacuum.

The corrector rods 32 of this invention are secured to end plate 33 adjacent to each end of the superconducting magnet.

Figure 2:
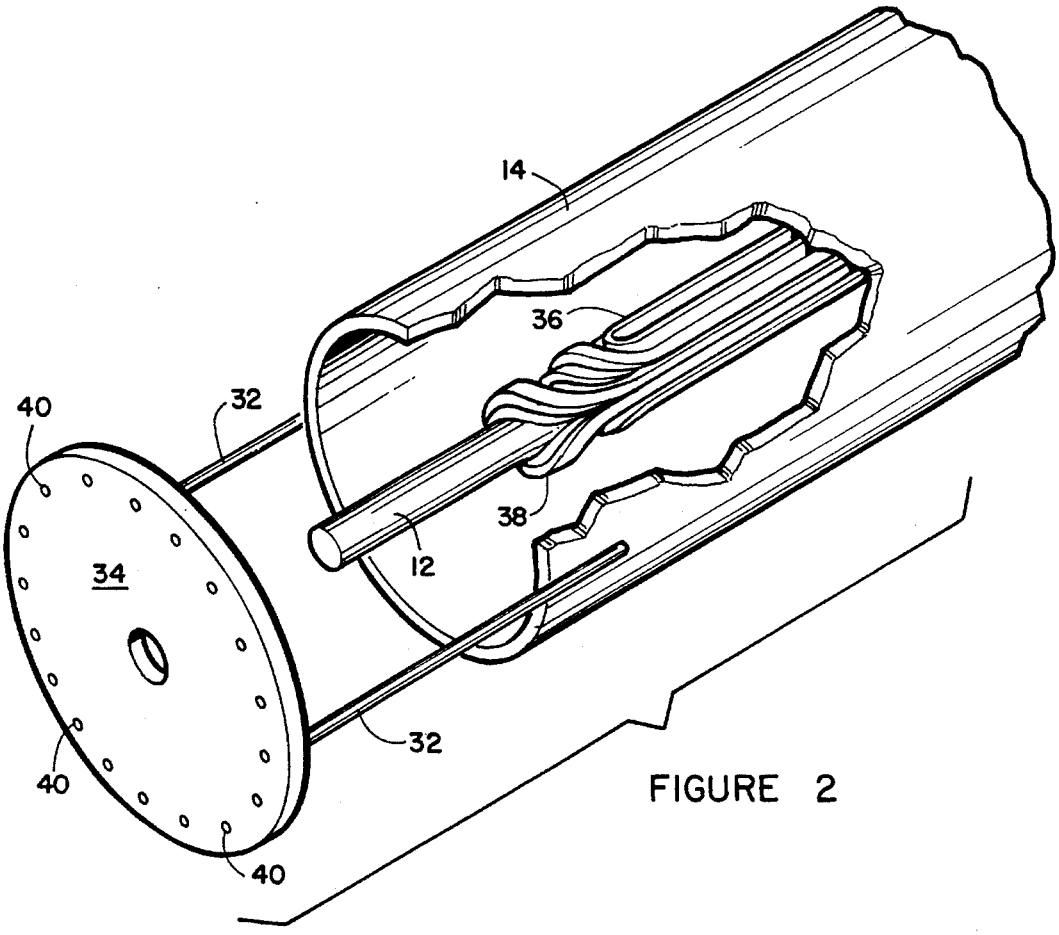
FIG. 2 is a schematic exploded view of the relationship between the corrector rod assembly and the magnet assembly.

FIG. 2 schematically shows the helium vessel 14 with the near side cut away to show the beam tube 12 that runs down the center of vessel 14. Dipole superconducting magnet coils 36 surround beam tube 12. At each end of each magnet assembly, coils 36 the magnetic fields reverse direction at an end region 38. The beam distorting harmonics have greatest effect in end region 38.

End plate 34 has a plurality of peripheral holes 40 sized to receive an end of a corrector rod 42, two of which are used in the embodiment illustrated. End plate 40 is secured to the end of helium vessel by any suitable means, such as welding, bolts or the like. The end of vessel 14 could have a separate cover with end plate 40 fastened to that cover. Holes 40 lie in a circle just larger that the outside surface of helium vessel 14, so that when rods 42 are secured in selected holes the rods extend along the surface of vessel 14 generally parallel to beam tube 12. The number, size, material and placement of the rods will be determined for a particular application.

The Superconducting Supercollider uses about 8 thousand 15 meter magnet assemblies. Different sets or groups of magnets may be made by different vendors, may use different lots of superconductor material or other material, etc. While all of the magnets in one lot may be similar and have tight manufacturing tolerances, magnets from different lots may exhibit variations. For example, one component, the collars that hold the superconducting coils against the beam tubes, has been found to vary somewhat from lot to lot. We have found that random variations can generally be accommodated by the system. However, a consistent variation, such as where each magnet slightly misdirects the particle beam in the same manner, may cause an accumulating error that rapidly becomes a significant problem in maintaining correct particle flow over long periods. Thus, the use of identical arrangements of corrector rods in each of a specific lot of magnets can reduce or eliminate these accumulating errors.

The optimum number, dimensions and locations of corrector rods for a specific set of substantially identical magnet assembles is determined by trial and error, initially, with the assistance of experience and computer simulations where available. Once the optimum arrangement is determined and confirmed by warm magnet tests, the same arrangement is installed in all of the other magnets of that set.

Other applications, variations and ramifications of this invention will occur to those skilled in the art upon reading this disclosure. Those are intended to be included within the scope of this invention, as defined in the appended claims.

We claim:

1. A system for correcting for multipole harmonics in superconducting accelerator magnet ends in a superconducting magnet assembly which comprises:

a plate of non-magnetic material secured to and covering each end of a superconductor accelerator magnet, having a central opening through which a magnet beam tube can project;

at least one pair of corrector rods secured to said plate and positioned to surround said superconductor accelerator magnet which surrounds said beam tube when said plate is secured to the end of said superconductor accelerator magnet assembly;

said corrector rods formed uniformly over their lengths from a material selected from the group consisting of magnetic, paramagnetic and superconducting materials;

said corrector rods extending beyond the ends of said superconductor accelerator magnet;

the length and diameter of each of said corrector rods selected in accordance with warm and cold field measurements of multipole harmonics in said accelerator magnet.

2. The system for correcting for multipole harmonics in a superconducting accelerator magnet according to claim 1 wherein said corrector rods comprise a metal selected from the group consisting of iron, nickel, Monel alloys.

3. The system for correcting for multipole harmonics in a superconducting accelerator magnet according to claim 1 wherein the edges of said plate extend beyond an accelerator magnet helium container, said plate has a plurality of peripheral holes and said corrector rods are adapted to be secured in selected pairs of opposite holes.

4. The system for correcting for multipole harmonics in a superconducting accelerator magnet according to claim 3 wherein said holes are internally threaded and one end of each corrector rod is adapted to thread into any of said holes.

5. The system for correcting for multipole harmonics in a superconducting accelerator magnet according to claim 1 wherein said plate is formed from a non-magnetic stainless steel.

6. A method for correcting for multipole harmonics in a superconducting accelerator magnet having a beam tube for carrying a particle beam, an as assembly of magnet coils around the beam tube and a generally cylindrical helium vessel surrounding the beam tube and magnetic coil assembly, which comprises:

measuring multipole harmonics characteristic of the specific superconducting magnet assembly;

providing a plate of non-magnetic material having a plurality of equally spaced peripheral holes;

securing said plate to an end of the helium vessel with the circle formed by said holes being slightly greater than the outside diameter of said helium vessel;

providing a plurality of corrector rods formed from a material selected from the group consisting of magnetic, paramagnetic and superconducting materials;

selecting corrector rod number, placement and dimensions in accordance with said multipole harmonic measurement; and securing said selected corrector rods in selected opposite holes with said rods lying adjacent to the end regions of the assembly of magnet coils and substantially parallel thereto.

7. The method according to claim 6 including the further steps of measuring multipole harmonics with said corrector rods in place and modifying the number, placement and dimensions as necessary to further reduce multipole harmonics.

8. The method according to claim 7 including the further steps of installing the same arrangement of corrector rods in each superconducting magnet assembly from the same manufacturing set.

9. The method according to claim 6 wherein said plate is formed from a non-magnetic stainless steel.

10. The method according to claim 6 wherein said corrector rods comprise a material selected from the group consisting of iron, nickel, Monel alloys.

11. The method according to claim 6 wherein said plate holes are internally threaded, the ends of said corrector rods are correspondingly externally threaded and said rods are installed by threading them into said plate holes.

* * * * *

UNITED STATES PATENT AND TRADEMARK OFFICE

CERTIFICATE OF CORRECTION

PATENT NO. : 5,479,144

DATED : December 26, 1995

INVENTOR(S) : Husam Gurol

It is certified that error appears in the above-indentified patent and that said Letters Patent is hereby corrected as shown below:

Title Page, Item [54], in the title, "Connector" should read --Corrector--.

Column 1, line 1, in the title, "Connector" should read --Corrector--.

Signed and Sealed this

Sixth Day of August, 1996

*Attest:*

*Attesting Officer*

BRUCE LEHMAN

*Commissioner of Patents and Trademarks*